US008853919B2

(12) United States Patent
Lin et al.

(10) Patent No.: US 8,853,919 B2
(45) Date of Patent: Oct. 7, 2014

(54) ULTRASONIC SENSOR DEVICE

(75) Inventors: Chia-Yu Lin, Taoyuan County (TW); Tzu-Chin Tsai, Taoyuan County (TW); Chiun-Hua Chang, Taoyuan County (TW); Shih-Feng Lee, Taoyuan County (TW)

(73) Assignee: Tung Thih Electronic Co., Ltd., Taoyuan County (TW)

( * ) Notice: Subject to any disclaimer, the term of this patent is extended or adjusted under 35 U.S.C. 154(b) by 298 days.

(21) Appl. No.: 13/555,983

(22) Filed: Jul. 23, 2012

(65) Prior Publication Data

US 2013/0214642 A1 Aug. 22, 2013

(30) Foreign Application Priority Data

Feb. 21, 2012 (TW) ..... 101105657 A

(51) Int. Cl.
*B06B 1/06* (2006.01)

(52) U.S. Cl.
CPC ..... *B06B 1/0644* (2013.01)
USPC ..... 310/334; 310/348

(58) Field of Classification Search
CPC ..... B06B 1/06; B06B 1/0644; B06B 1/0651; B06B 1/0655
USPC ..... 310/322, 334, 335, 348
See application file for complete search history.

(56) References Cited

U.S. PATENT DOCUMENTS 6,876,127 B2 * 4/2005 Mitsuoka et al. ..... 310/324
7,545,082 B2 * 6/2009 Nakajima ..... 310/334
7,728,486 B2 6/2010 Matsuo

FOREIGN PATENT DOCUMENTS

CN 101055312 A 10/2007

* cited by examiner

*Primary Examiner* — Derek Rosenau
(74) *Attorney, Agent, or Firm* — Christie, Parker & Hale, LLP

(57) ABSTRACT

An ultrasonic sensor device includes a housing, a circuit board disposed at the housing, and a transducer. The transducer includes an electrically conductive casing having a bottom wall and a surrounding wall. A piezoelectric member is disposed on top of the bottom wall. A first connecting pin set is disposed in the housing, and includes a first connecting pin having one end connected to the circuit board and another end connected to the piezoelectric member, and a second connecting pin having one end connected to the circuit board and another end connected to the surrounding wall. A second connecting pin set is disposed in the housing, has one end connected to the circuit board, and another end extended into a connecting portion of the housing.

9 Claims, 7 Drawing Sheets

ULTRASONIC SENSOR DEVICE

CROSS-REFERENCE TO RELATED APPLICATION

This application claims priority of Taiwanese Application No. 101105657, filed on Feb. 21, 2012.

BACKGROUND OF THE INVENTION

1. Field of the Invention

The invention relates to a transducer, more particularly to an ultrasonic sensor device that incorporates the transducer.

2. Description of the Related Art

Shown in FIG. 1 is a conventional ultrasonic sensor device. The ultrasonic sensor device includes a housing 1 with a connecting portion 2, and a transducer 3. A circuit board 11 is disposed in the housing 1. As shown in FIG. 2, the transducer 3 has a casing 31 formed from aluminum, a piezoelectric member 32 disposed on top of a bottom wall of the casing 31, a relaying circuit board 33 disposed above the piezoelectric member 32, and a conductive wire set 34 that electrically interconnects the circuit board 11 and the relaying circuit board 33. The relaying circuit board 33 is further electrically connected to the piezoelectric member 32 via a first connecting wire 36, and to the casing 31 via a second connecting wire 37. The piezoelectric member 32 is operable to generate a sensing signal, which is received by the relaying circuit board 33 and transmitted to the circuit board 11 via the conductive wire set 34. The circuit board 11 is operable to process the sensing signal to generate a processed signal and is mounted with a connecting pin set 12 that includes two connecting pins, which serve to output the processed signal and to connect to ground, respectively.

However, such configuration of the conventional ultrasonic sensor device has some drawbacks. For example, connection between the second connecting wire 37 and the casing 31 is typically by soldering, but the casing 31 is made from a material (aluminum) with a very high melting point. Moreover, the conductive wire set 34, the first connecting wire 36, and the second connecting wire 37 are also connected by soldering, thereby making the manufacturing procedure more difficult. Additionally, the sensing signal generated by the piezoelectric member 32 is relayed by the relaying circuit board 33 before being transmitted to the circuit board 11 for processing. It is preferable that the sensing signal be transmitted directly to the circuit board 11 in order to avoid signal attenuation.

SUMMARY OF THE INVENTION

Therefore, the object of the present invention is to provide an ultrasonic sensor device that has a relatively simple structure and that allows direct signal transmission.

Accordingly, an ultrasonic sensor device of the present invention comprises a housing, a circuit board, a transducer, a first connecting pin set and a second connecting pin set.

The housing includes an enclosing portion and a connecting portion. The enclosing portion is formed with a first opening and a second opening that is opposite to the first opening and that is in spatial communication with the first opening. The connecting portion has a first end connected to the enclosing portion and a second end formed with a third opening.

The circuit board is disposed at the first opening of the enclosing portion.

The transducer includes an electrically conductive casing and a piezoelectric member. The casing has a bottom wall and a surrounding wall that cooperate to define a receiving space. The piezoelectric member is disposed on top of the bottom wall. The surrounding wall is formed with a pin engaging hole. The transducer is mounted to the enclosing portion at the second opening in a manner that the receiving space and the pin engaging hole open toward the first opening.

The first connecting pin set is disposed in the enclosing portion, and includes a first connecting pin and a second connecting pin.

The first connecting pin has one end connected electrically to the circuit board and another end extending into the receiving space and connected electrically to the piezoelectric member. The second connecting pin has one end connected electrically to the circuit board and another end extending into the pin engaging hole to connect electrically with the surrounding wall.

The second connecting pin set is disposed in the enclosing portion and has one end connected electrically to the circuit board and another end extended into the connecting portion toward the third opening.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
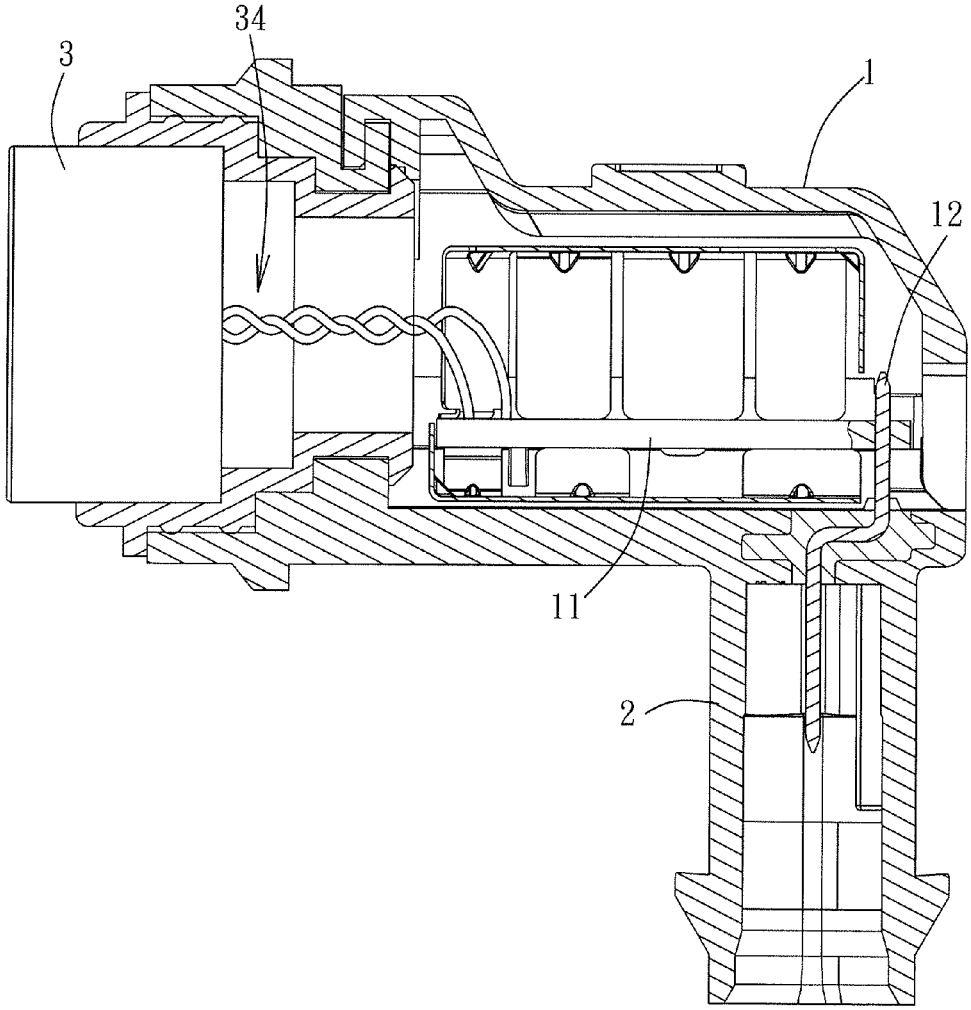
F I G. 1 PRIOR ART
FIG. 1 is a sectional view of a conventional ultrasonic sensor device.
Figure 2:
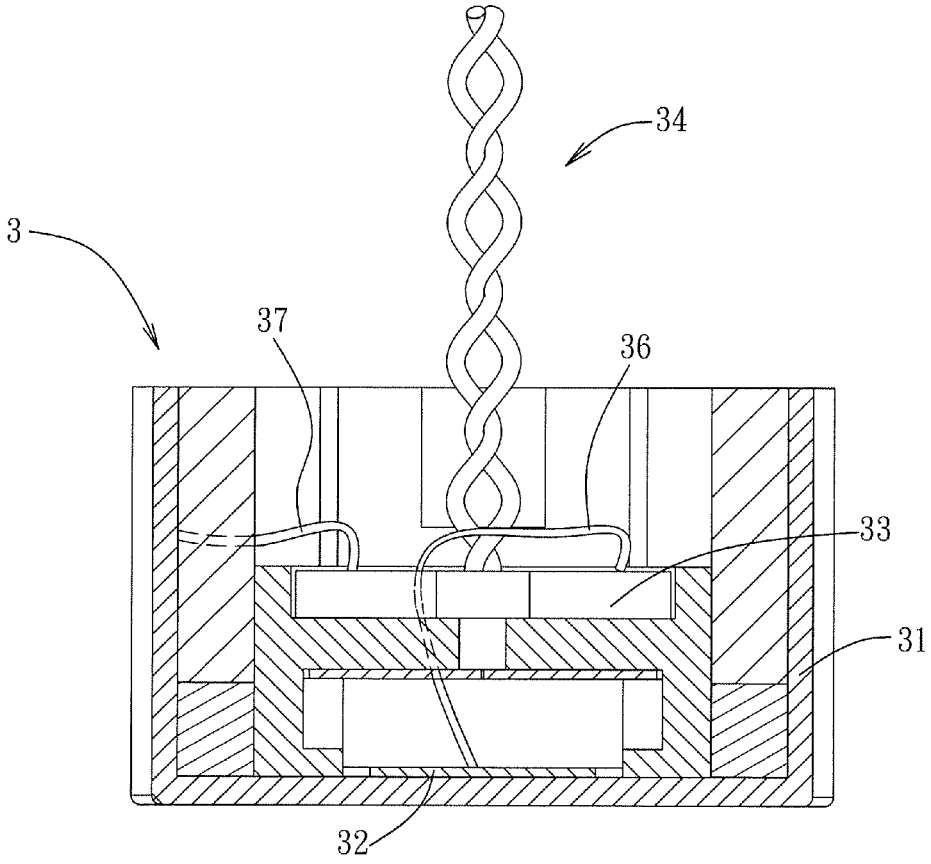
F I G. 2 PRIOR ART
FIG. 2 is a sectional view of a transducer of the conventional ultrasonic sensor device.
Figure 3:
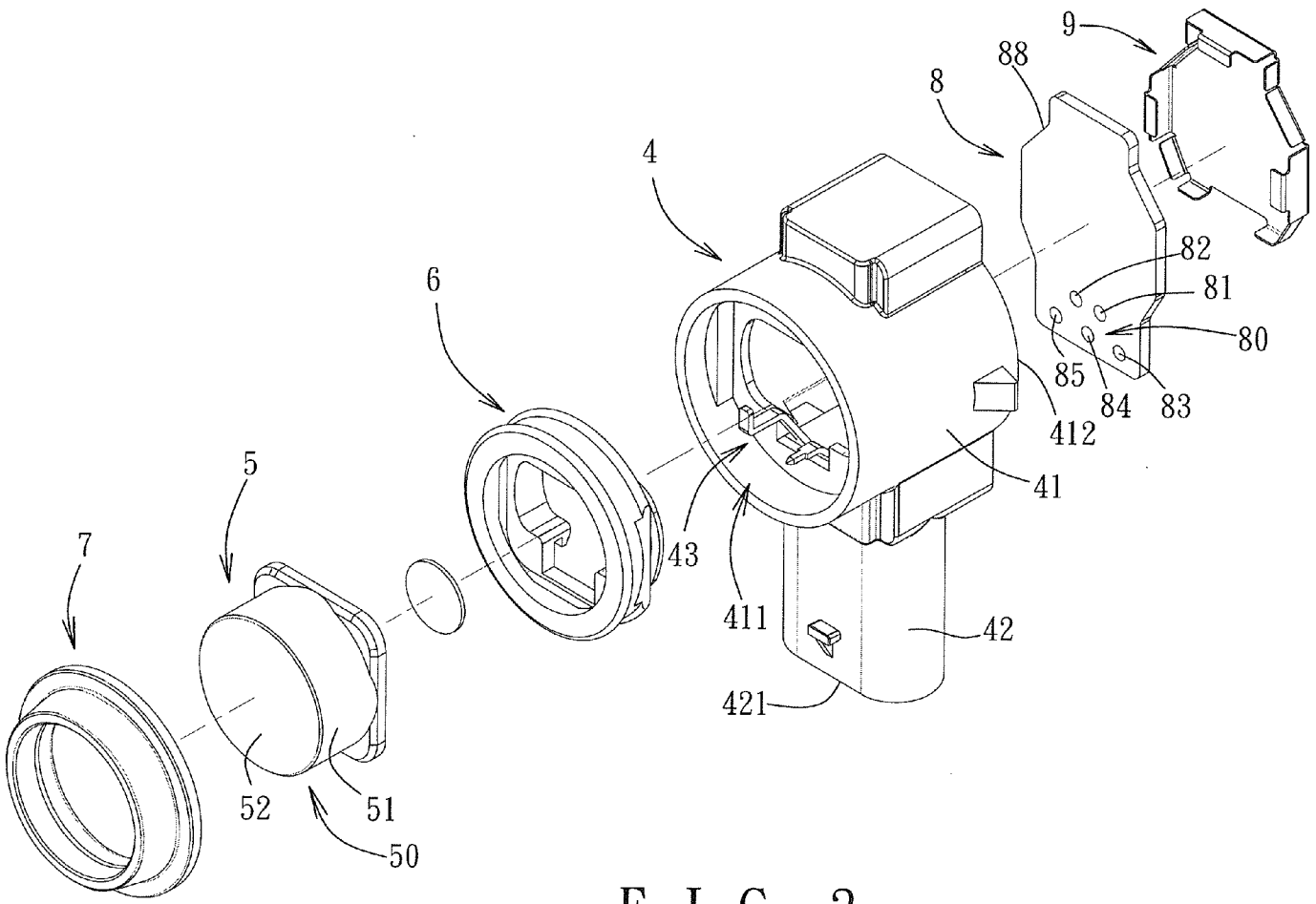
FIG. 3 is an exploded perspective view of a preferred embodiment of an ultrasonic sensor device according to the invention.
Figure 4:
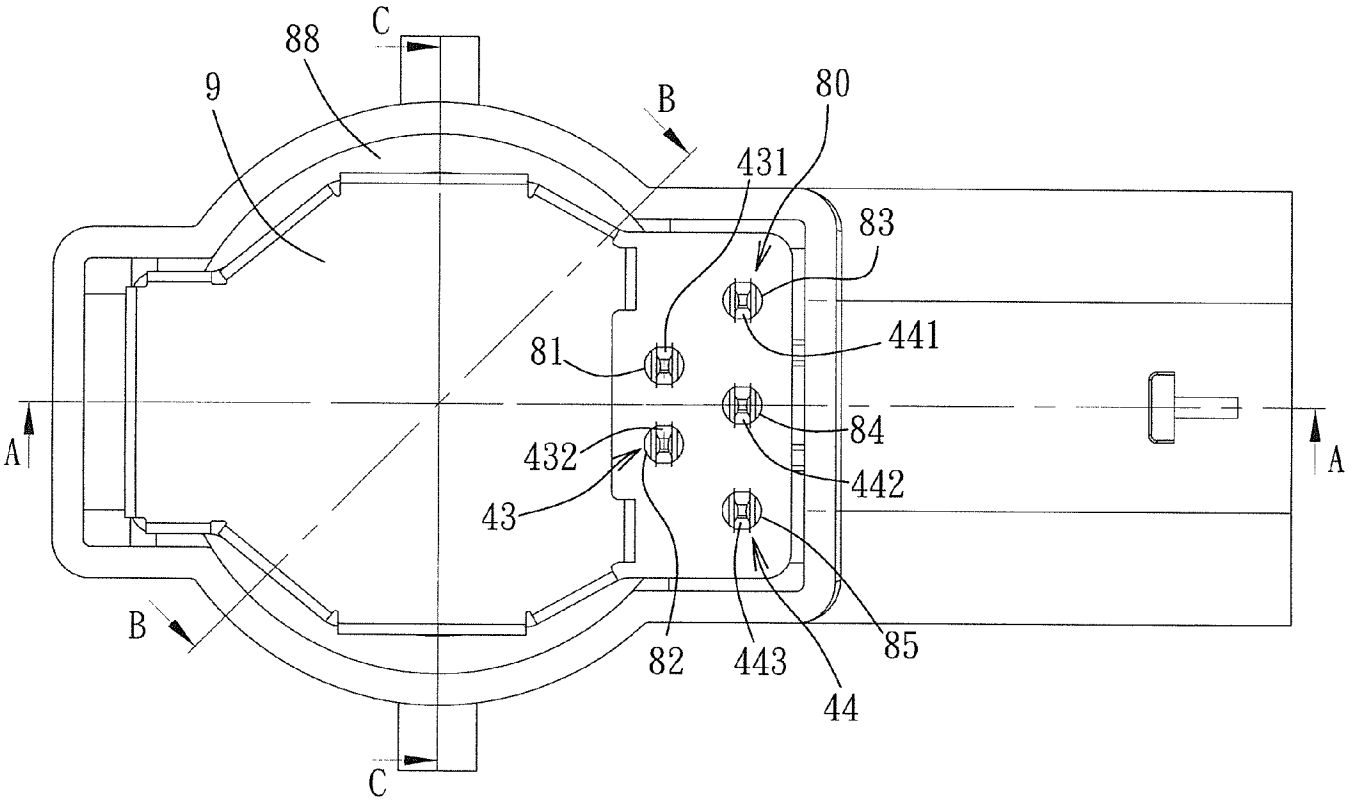
FIG. 4 is a top view of the ultrasonic sensor device according to the embodiment.
Figure 5:
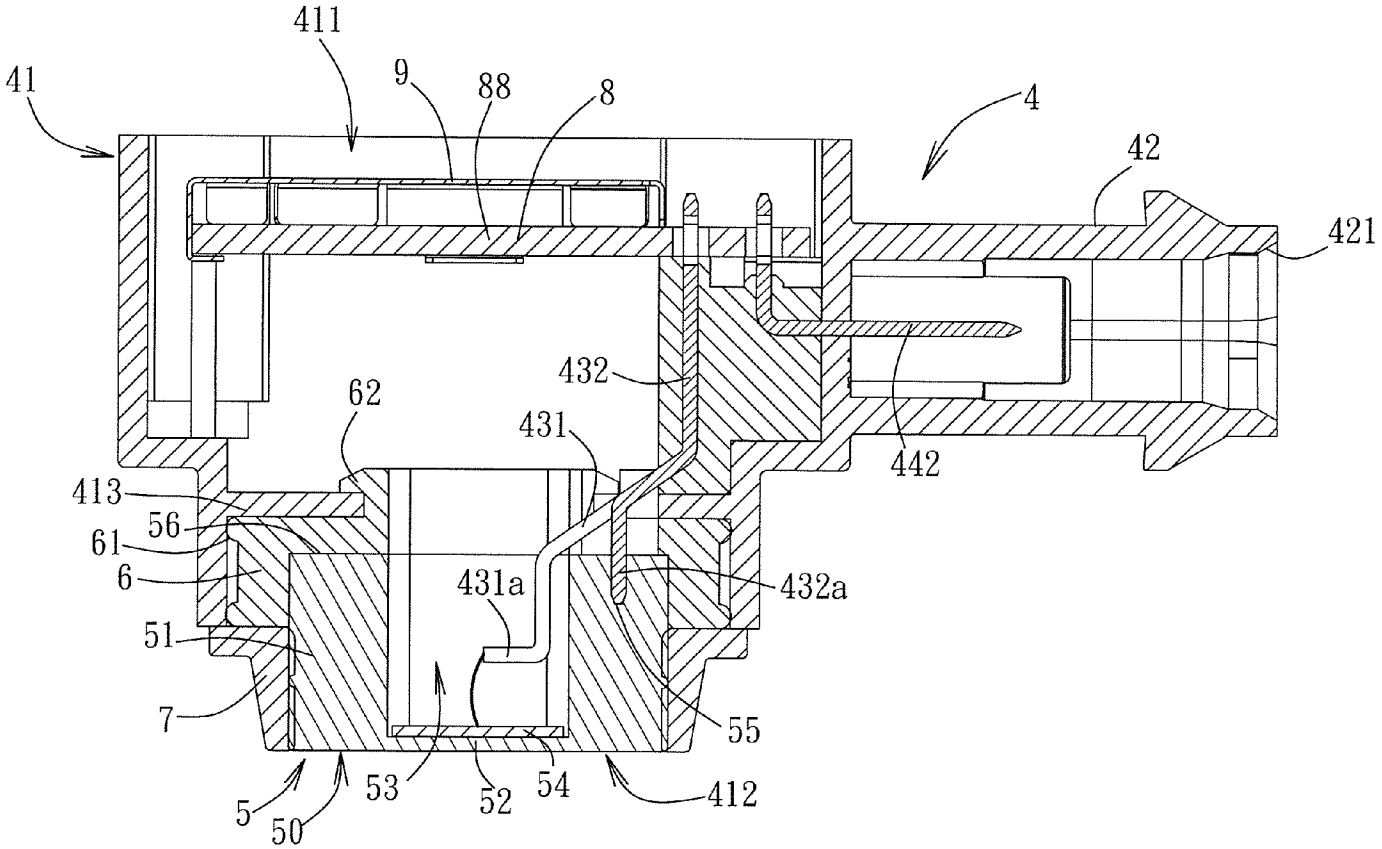
FIG. 5 is a sectional view taken along line A-A of FIG. 4.

As shown in FIGS. 3 to 5, the preferred embodiment of an ultrasonic sensor device according to the present invention comprises a housing 4, a first connecting pin set 43, a second connecting pin set 44, a transducer 5, a surrounding seat 6, an O-ring 7, a circuit board 8 and a cover 9.

The housing 4 includes an enclosing portion 41 and a connecting portion 42. The enclosing portion 41 is in the form of an annular surrounding wall, and is formed with a first opening 411, and a second opening 412 that is opposite to the first opening 411 and that is in spatial communication with the first opening 411. The connecting portion 42 is tubular, and has a first end connected to the enclosing portion 41, and a second end formed with a third opening 421. In this embodiment, the connecting portion 42 is formed integrally with the enclosing portion 41, but can be connected using other configurations in other embodiments.

The transducer 5 includes an electrically conductive casing 50 (e.g., formed from aluminum) and a piezoelectric member 54. The casing 50 has a surrounding wall 51 and a bottom wall 52 that cooperate to define a receiving space 53. In this embodiment, the bottom wall 52 is formed integrally with the surrounding wall 51, but can be connected using other configurations in other embodiments. The surrounding wall 51 is formed with a pin engaging hole 55 on a top surface 56 thereof that is distal from the bottom wall 52. The transducer 5 is mounted to the enclosing portion 41 at the second opening 412 in a manner that the receiving space 53 and the pin engaging hole 55 open toward the first opening 411.

The circuit board 8 is disposed at the first opening 411 of the enclosing portion 41. As shown in FIG. 4, the circuit board 8 has a connecting port set 80 for connecting electrically with the first connecting pin set 43 and the second connecting pin set 44, and a circuit disposal area 88 for allocating circuit needed for operation of the ultrasonic sensor device.

The first connecting pin set 43 is disposed in the enclosing portion 41 of the housing 4, and includes a first connecting pin 431 and a second connecting pin 432. The first connecting pin 431 has one end connected electrically to the connecting port set 80 of the circuit board 8, and another end 431*a* that extends into the receiving space 53 and that is connected electrically to the piezoelectric member 54. Electrical connection between the end 431*a* and the piezoelectric member 54 can be established by wire bonding or direct connection. Wire bonding is utilized in this embodiment. The second connecting pin 432 has one end connected electrically to the connecting port set 80 of the circuit board 8. Another end 432*a* of the second connecting pin 432 extends fittingly into the pin engaging hole 55 to connect electrically with the surrounding wall 51. The receiving space 53 of the transducer 5 is typically filled with a sealing component (not shown) which, when solidified, encapsulates the piezoelectric member 54 and the end 431*a* of the first connecting pin 431.

The second connecting pin set 44 is disposed in the enclosing portion 41, and includes a third connecting pin 441, a fourth connecting pin 442 and a fifth connecting pin 443. Each of the third to fifth connecting pins 441-443 has one end connected electrically to the connecting port set 80 of the circuit board 8 and another end extended into the connecting portion 42 toward the third opening 421. Correspondingly, the connecting port set 80 of the circuit board 8 has five connection ports 81-85 for connecting electrically and respectively with the first to fifth connecting pins 431-432, 441-443. Connection between the connection ports 81-85 and the connecting pins 431-432, 441-443 may be by soldering or fitting.

Figure 6:
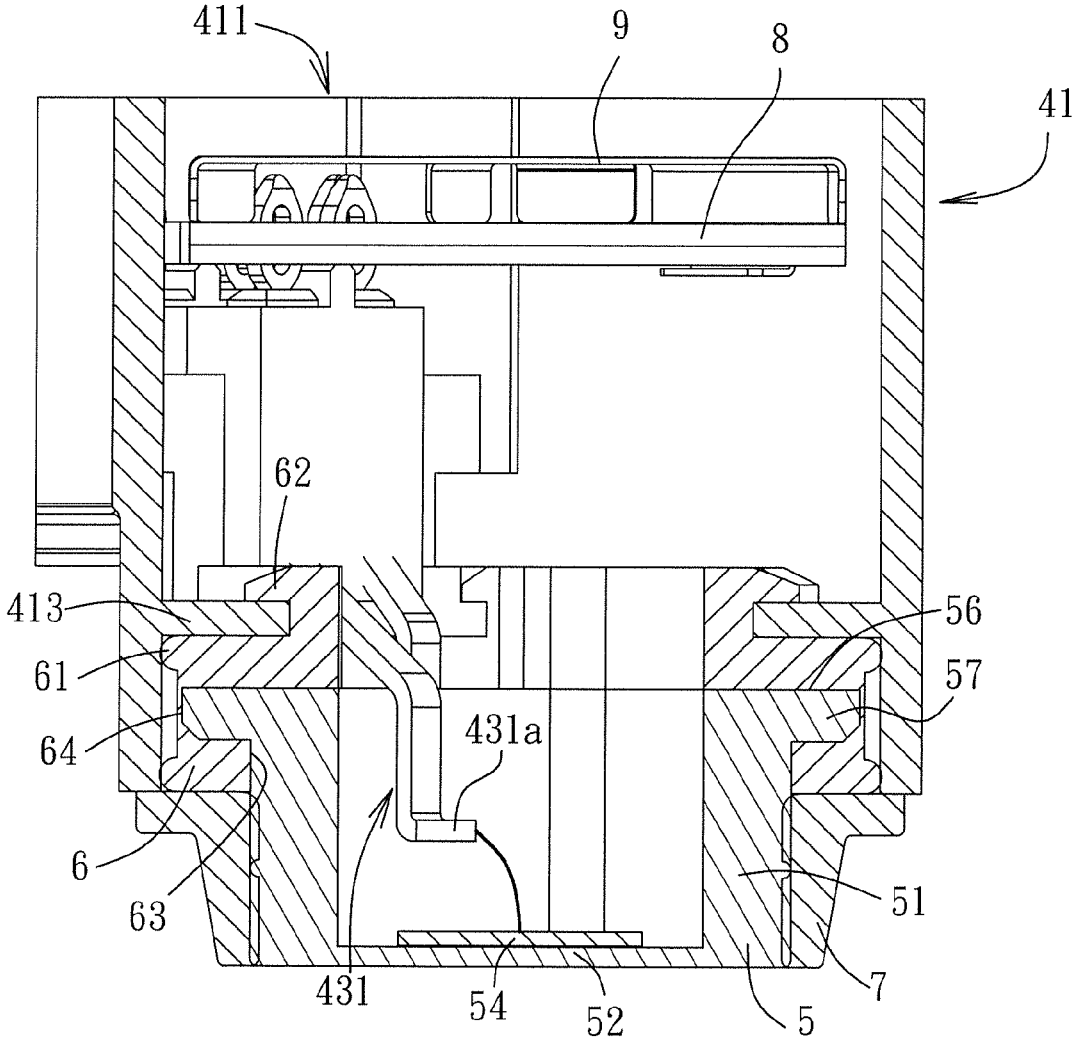
FIG. 6 is a sectional view taken along line B-B of FIG. 4.
Figure 7:
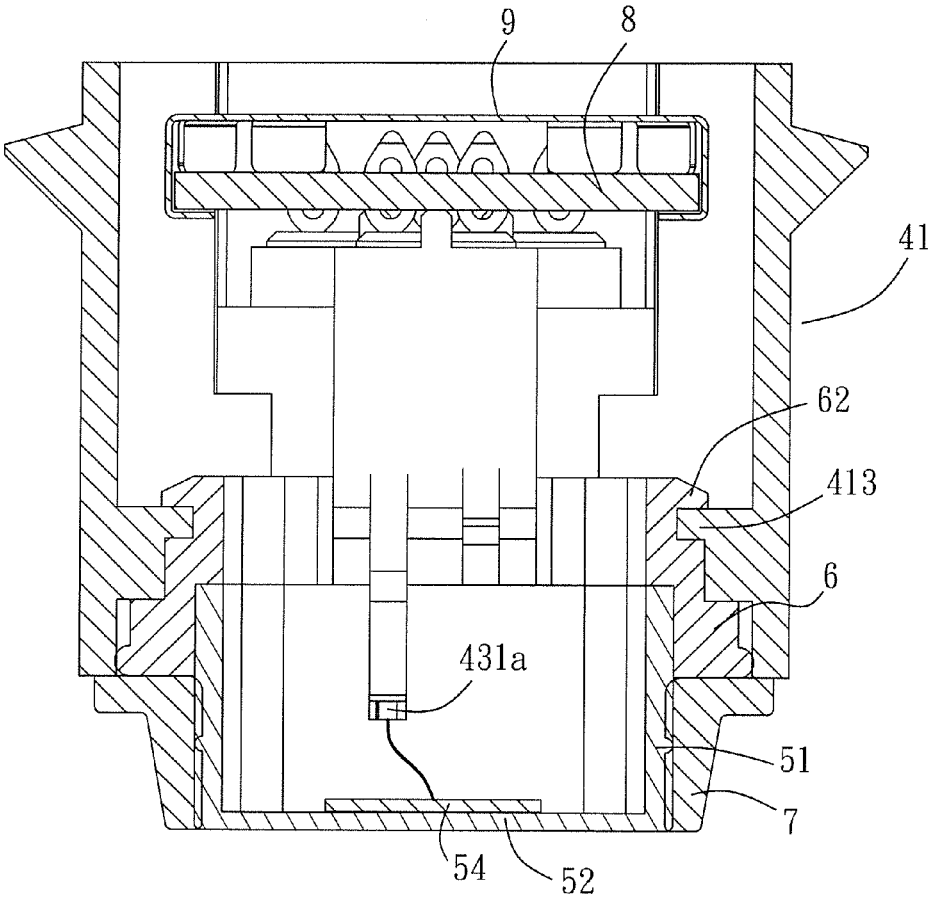
FIG. 7 is a sectional view taken along line C-C of FIG. 4.

Securing of the transducer 5 to the enclosing portion 41 can be aided by the surrounding seat 6, which is formed from an elastic material (e.g., plastic in this embodiment). Specifically, as shown in FIGS. 5 to 7, the surrounding seat 6 has an outer surface 61 formed with a first engaging component 62, and an inner surface 63 formed with a second engaging component 64 which is in the form of a groove. The enclosing portion 41 is further formed with an inwardly projecting first engaging portion 413 proximate to the second opening 411 for engaging the first engaging component 62. The surrounding wall 51 is further formed with an outwardly projecting second engaging portion 57 for engaging the second engaging component 64. The transducer 5 can be mounted to the surrounding seat 6 by engaging the second engaging portion 57 to the second engaging component 64, and can be secured to the enclosing portion 41 by engaging the first engaging portion 413 to the first engaging component 62. In this embodiment, after the transducer 5 is secured to the enclosing portion 41, a part of the surrounding wall 51 and the bottom wall 52 are disposed outwardly of the housing 4.

In order to protect the part of the surrounding wall 51 of the transducer 5 that is disposed outwardly, the O-ring 7 is sleeved on the part of the surrounding wall 51. It is noted that, the bottom wall 52 remains exposed so as to prevent signal attenuation. Moreover, in order to protect the ultrasonic sensor device from interference attributed to electromagnetic waves, the cover 9 is disposed on the circuit board 8 (see FIG. 4) to cover the circuit disposal area 88 of the circuit board 8. Afterward, the enclosing portion 41 can be filled with the sealing component (not shown) so as to encapsulate the circuit board 8 and the cover 9.

The succeeding paragraphs are directed to signal transmission within the ultrasonic sensor device.

Each of the first and third connecting pins 431 and 441 serves as a signal transmitting pin. Each of the second and fourth connecting pins 432 and 442 serves as a grounding pin. The fifth connecting pin 443 serves as a power pin. The piezoelectric member 54 is operable to generate a sensing signal, which is transmitted to the circuit board 8 via the first connecting pin 431. The circuit board 8 is then operable to process the sensing signal and to output a processed signal (e.g., to an external connector) via the third connecting pin 441. The circuit board 8 is configured to interconnect electrically the second and fourth connecting pins 432 and 442, and to receive an input power signal (e.g., from an external power source) via the fifth connecting pin 443.

As an example, the ultrasonic sensor device of this embodiment may be connected to an automobile. The fourth connecting pin 442 is electrically connected to the automobile for providing a reference ground. The fifth connecting pin 443 is electrically connected to a power source of the automobile, such that the circuit board 8 is operable to receive the input power signal therefrom via the fifth connecting pin 443. The processed signal generated by the circuit board 8 can be transmitted to the automobile via the third connecting pin 441 for subsequent processing and analyzing.

It is noted that a couple of elements described in this embodiment are not mandatory for the ultrasonic sensor device to function properly and may be omitted in other embodiments. For example, the transducer 5 can be secured to the enclosing portion 41 of the housing 4 by other means, such that the surrounding seat 6 may be omitted. When the ultrasonic sensor device is operated in an environment where protection of the part of the surrounding wall 51 is not an important issue, the O-ring 7 may be omitted. Similarly, when the ultrasonic sensor device is operated in an environment where electromagnetic wave interference is not an important issue, the cover 9 may be omitted.

To sum up, the ultrasonic sensor device of this invention introduces the first and second connecting pin sets 43 and 44, such that the electrical connections within the ultrasonic sensor device can be established directly without using a relaying circuit board, thereby simplifying the structure of the ultrasonic sensor device and minimizing signal attenuation.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An ultrasonic sensor device, comprising:

a housing including an enclosing portion formed with a first opening and a second opening that is opposite to said first opening and that is in spatial communication with said first opening, and a connecting portion having a first end connected to said enclosing portion and a second end formed with a third opening;

a circuit board disposed at said first opening of said enclosing portion;

a transducer including an electrically conductive casing having a bottom wall and a surrounding wall that cooperate to define a receiving space, and a piezoelectric member disposed on top of said bottom wall, said surrounding wall being formed with a pin engaging hole, said transducer being mounted to said enclosing portion at said second opening in a manner that said receiving space and said pin engaging hole open toward said first opening;

a first connecting pin set disposed in said enclosing portion, said first connecting pin set including a first connecting pin having one end connected electrically to said circuit board and another end extending into said receiving space and connected electrically to said piezoelectric member, and a second connecting pin having one end connected electrically to said circuit board and another end extending into said pin engaging hole to connect electrically with said surrounding wall; and a second connecting pin set disposed in said enclosing portion and having one end connected electrically to said circuit board and another end extended into said connecting portion toward said third opening.

2. The ultrasonic sensor device as claimed in claim 1, wherein:

said first connecting pin serves as a signal transmitting pin;

said second connecting pin serves as a grounding pin; and said second connecting pin set includes a third connecting pin serving as a signal transmitting pin, a fourth connecting pin serving as a grounding pin, and a fifth connecting pin serving as a power pin.

3. The ultrasonic sensor device as claimed in claim 2, wherein:

said piezoelectric member is operable to generate a sensing signal that is transmitted to said circuit board via said first connecting pin;

said circuit board is operable to process the sensing signal and to output a processed signal via said third connecting pin;

said circuit board is configured to interconnect electrically said second and fourth connecting pins; and said circuit board is configured to receive an input power signal via said fifth connecting pin.

4. The ultrasonic sensor device as claimed in claim 2, wherein said circuit board has five connection ports for connecting electrically and respectively with said first to fifth connecting pins.

5. The ultrasonic sensor device as claimed in claim 1, further comprising a surrounding seat that has said transducer mounted thereto and that engages said enclosing portion at said second opening for securing said transducer to said enclosing portion.

6. The ultrasonic sensor device as claimed in claim 1, wherein a part of said surrounding wall and said bottom wall are disposed outwardly of said housing, said ultrasonic sensor device further comprising an O-ring sleeved on said part of said surrounding wall.

7. The ultrasonic sensor device as claimed in claim 1, further comprising a cover disposed on said circuit board.

8. The ultrasonic sensor device as claimed in claim 7, further comprising a sealing component that fills said enclosing portion to encapsulate said circuit board and said cover.

9. The ultrasonic sensor device as claimed in claim 1, wherein said transducer further includes a sealing component that fills said receiving space to encapsulate said piezoelectric member and said another end of said first connecting pin.

* * * * *